United States Patent [19]

Kuiper

[11] 4,215,863

[45] Aug. 5, 1980

[54] COIN OPERATED SLIDING PUCK GAME

[76] Inventor: Jerald W. Kuiper, 5949 Oak Lane Dr., Butte Des Mortes, Wis. 54927

[21] Appl. No.: 935,955

[22] Filed: Aug. 23, 1978

[51] Int. Cl.[2] ..... A63F 3/00

[52] U.S. Cl. ..... 273/126 R; 273/128 R

[58] Field of Search ..... 273/126 R, 126 A, 121 R, 273/121 A, 121 D, 121 E, 85 R, 125 R, 125 A, 119 R, 119 A, 119 D, 124 R, 124 A, 123 R, 123 A, 122 R, 122 A, 128

[56] References Cited

U.S. PATENT DOCUMENTS

| | | | |
|---|---|---|---|
| 2,565,238 | 8/1951 | Koci | 273/126 A |
| 2,593,641 | 4/1952 | Walverton | 273/126 A |
| 3,228,688 | 1/1966 | Dennison | 273/125 A |
| 3,817,519 | 6/1974 | Leonhart | 273/126 A |

*Primary Examiner*—Richard C. Pinkham
*Assistant Examiner*—T. Brown
*Attorney, Agent, or Firm*—Andrus, Sceales, Starke & Sawall

[57] ABSTRACT

A coin operated, sliding puck game having a generally flat playing surface, and a series of compartments are located at one end of the playing surface. Openings or gates provide communication between the playing surface and the compartments, and the players slide pucks along the playing surface and attempt to direct the pucks through the gates into the compartments to register a score. The upper ends of the compartments are enclosed by a hinged, transparent cover which is operably interconnected with a series of pegs that are mounted for movement within openings disposed in alignment with the gates. When the cover is in an open position, the pegs project into the gates and prevent play of the game. By inserting a coin in an operating mechanism, the cover will automatically move to a closed position and the pegs will move out of the obstructing position so that the game is operable for play.

12 Claims, 6 Drawing Figures

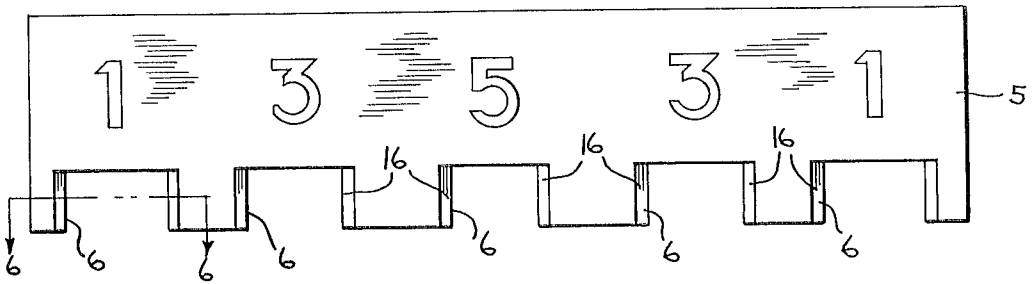
Fig. 5
Fig. 6
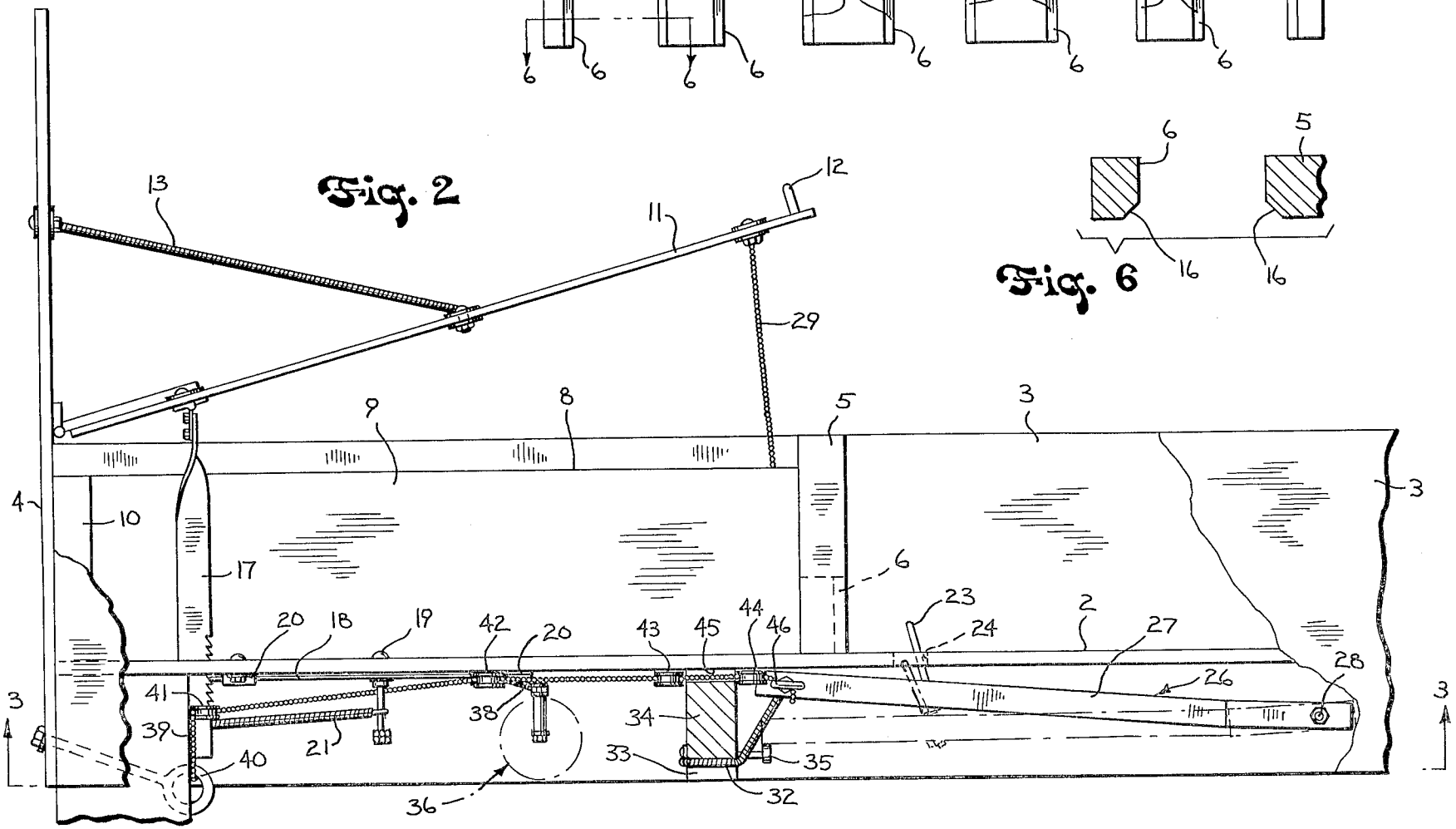
Fig. 2

COIN OPERATED SLIDING PUCK GAME

BACKGROUND OF THE INVENTION

Various coin-operated, skill type games have been used in the past for entertainment. The most common coin-operated game is pinball in which a ball is propelled by a plunger onto a sloping playing surface, and as the ball travels down the playing surface it engages various bumpers and gates which operate through electronic circuitry to register points on a scoreboard.

In another common type of coin-operated game, pucks are directed by the player along a flat playing surface toward a series of simulated bowling pins, and the bowling score is electronically registered on a scoreboard.

The conventional coin-operated, skill-type game is expensive because of the electronic controls and due to its complexity, requires substantial maintenance. Therefore, there has been a need for an inexpensive, coin-operated, skill-type game to be used in commercial establishments.

SUMMARY OF THE INVENTION

The invention is directed to an improved coin-operated, sliding puck game. In accordance with the invention, the game includes a generally flat playing surface and the player slides pucks along the playing surface toward a transverse wall that contains a number of openings or gates. Different scores are achieved for directing the puck into the various gates.

Located behind each gate is a closed compartment, and the upper ends of the compartments are enclosed by a transparent hinged cover. By viewing the pucks in the various compartments through the transparent cover the player can visually determine his score.

The game is designed to be coin operated, and when the game is completed, a mechanism is provided which will prevent the game from being replayed until a coin is inserted in the coin mechanism. More specifically, the cover is operably connected through a linkage to a series of stops or pins which are mounted for movement within openings in the playing surface and are aligned with the various gates. When the cover is moved to the open position to remove the pucks from the compartments, the pins are moved to an obstructing position in the gates to prevent play of the game.

By inserting a coin in the coin operating mechanism, the cover locking mechanism is released, enabling the cover to move to the closed position and correspondingly moving the pegs to a non-obstructing position so that the game is then operable for play.

During the course of play, when all of the pucks of any player are in the compartments, the game is completed, and any attempt to remove the pucks from the compartments by lifting the cover will automatically elevate the pins into an obstructing position so that further play is not possible.

In the preferred form of the invention, the openings or gates have different widths so that a greater score is obtained for directing the puck into the gates of smaller width.

A wide variety of games can be played with the device of the invention. In one type, players will alternate shots and count points for the pucks that have been directed through the gates into the compartments. In another type of game, one player will shoot all of his pucks without alternating with the other player, while in another form, the low scorer is the winner and the players attempt to knock the opponent's pucks into the compartments, rather than directing their pucks into the compartments.

The game of the invention is an inexpensive construction which does not require the electronic circuitry of the conventional coin-operated commercial type game, and is particularly adaptable for either residential or commercial use.

Other objects and advantages will appear in the course of the following description.

DESCRIPTION OF THE DRAWINGS

The drawings illustrate the best mode presently contemplated of carrying out the invention.

In the drawings:

FIG. 2 is a fragmentary side elevation of the game with parts broken away in section;

FIG. 5 is a front elevation of the wall containing the gates; and

FIG. 6 is a section taken along line 6—6 of FIG. 5.

DESCRIPTION OF THE PREFERRED EMBODIMENT

Figure 1:
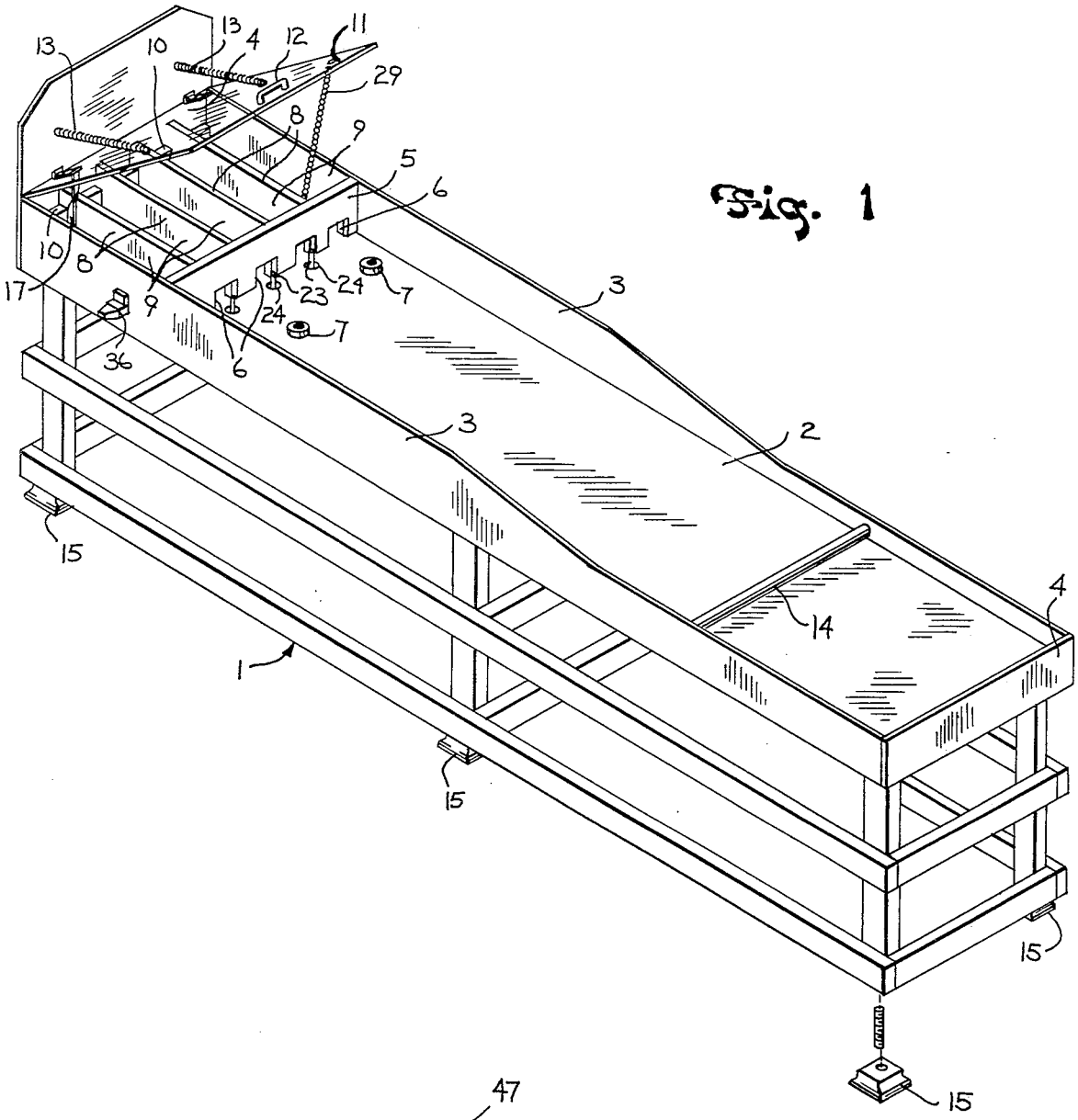
FIG. 1 is a perspective view of the game of the invention.

The drawings illustrate a coin-operated, sliding puck game which includes a supporting structure or frame 1 that supports a generally flat, playing surface 2. Bordering the playing surface are a pair of side walls 3 and end walls 4. In addition, a transverse wall 5 extends across the playing surface and is spaced from the rear end wall 4 and is provided with a series of openings or gates 6. The player will stand at the right hand end of the playing surface, as viewed in FIG. 1, and slide the pucks 7 across the surface 2, attempting to direct the pucks through the gates or openings 6. As shown in FIG. 5, a score, i.e. 1, 3, or 5, is indicated above each gate 6.

Extending between the wall 5 and the rear end wall 4 are a series of parallel divider walls 8 which define compartments 9, and each compartment communicates with one of the gates 6. Mounted in the rear of each compartment is a rebound wall 10 formed of compressed paperboard or the like, and as the puck 7 enters the compartment, it will strike the rebound wall 10 and rebound forwardly, in some cases rebounding through the gates and back onto the playing surface 2.

The open upper ends of the compartments 9 are enclosed by a transparent cover 11 which is hinged to the rear end wall 4. The forward edge of the cover is provided with a lifting handle 12 and a pair of springs 13 interconnect the cover and the rear end wall 4 and aid in counterbalancing the weight of the cover.

Spaced forwardly of the front end wall 4 is a foul bar 14 and the bar is located a sufficient distance above the playing surface so that the pucks 7 can slide beneath the foul bar. The foul bar 14 limits the point of release of the pucks.

The supporting structure or frame 1 can be leveled through a series of adjustable feet 15 which are connected to the frame.

In play, the player slides the pucks beneath the foul bar 14 and attempts to direct the pucks into one of the gates or openings 6, either by sliding the puck directly through the openings or caromming the puck off the side walls 3. In the preferred form of the invention, the openings 6 have different widths with the opening of the smallest width, as shown in FIG. 5, having the greatest point value and the openings of greater width having a lesser point value. The forward vertical edges bordering the openings can be bevelled, as shown by 16, to provide added deflection for the pucks striking the edge.

Figure 3:
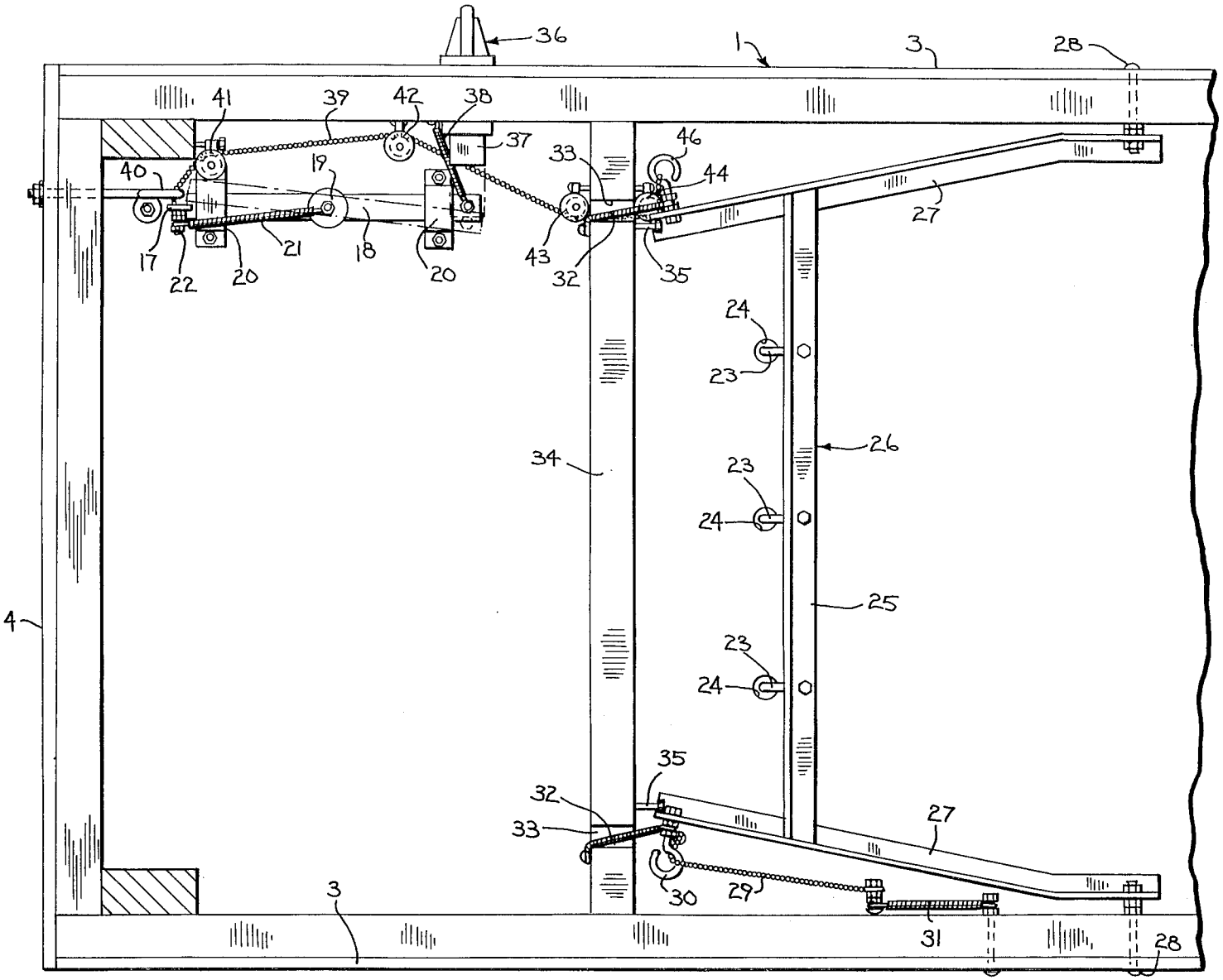
FIG. 3 is a horizontal section taken along line 3—3 of FIG. 2.

The cover 11, which encloses the compartments 9, can be freely lifted to an open position, but will be automatically locked in an open position by a pawl and ratchet mechanism. The pawl and ratchet mechanism includes a ratchet bar 17 which is pivotally attached to the undersurface of the cover and is provided with a series of teeth that are engaged by a generally horizontal pawl bar 18 which is mounted beneath the playing surface 2. As best shown in FIG. 3, the pawl bar 18 is mounted for pivotal movement in a horizontal plane about the pivot 19 and the end portions of the pawl bar are guided in horizontal pivoting within off-set guide brackets 20 that are secured to the undersurface of playing surface 2, as shown in FIG. 2. As best illustrated in FIG. 3, the rear end of the pawl bar 18 engages the ratchet teeth to hold the cover at an open position and prevent the cover from being lowered unless the locking mechanism is released.

A spring 21 is connected between the pivot 19 and a stud 22 mounted on the ratchet bar 17 and serves to urge the ratchet bar into engagement with the end of the pawl bar 18.

In accordance with the invention, when the cover is moved to an open position, a series of stops or pegs 23 are correspondingly moved into an obstructing position with respect to the gates or openings 6. The pegs 23 are normally in a nonobstructing position beneath the level of the playing surface 2, as shown by the phantom lines in FIG. 2, but as the cover is elevated, the pegs will be moved upwardly through openings 24 in the playing surface 2 into an obstructing position, as shown by the full line position in FIG. 2, so that the puck 7 cannot enter the opening or gate 6. While three pegs 23 are shown, it is contemplated that any number of pegs can be employed.

As best illustrated in FIG. 3, the pegs are mounted on a cross member 25 of frame 26. Side members 27 of the frame 26 are pivoted to the supporting structure 1 by bolts 28.

To interconnect the cover 11 and the frame 26, a chain 29 is attached to the underside of the cover and passes downwardly through an opening in the playing surface and is passed through an eye-bolt-30 mounted on one of the side members 27. One end of a spring 31 is attached through a bolt to the chain 29, while the opposite end of the spring 31 is connected to the frame 1. The spring is adapted to pick up the slack of the loose chain 29 when the cover 11 is in a closed position.

As the cover is elevated, the chain 29 will become taut and, because of the connection with eye bolt 30, will pivot the frame 26 upwardly, causing the pegs 23 to be moved through the openings 24 to an obstructing position.

To urge the frame 26 to a lower position, springs 32 are connected to the free ends of side members 27 and pass through holes 33 in the cross member 34. The rear ends of the springs 32 are connected to the studs on the cross member, as best shown in FIG. 3, so that the force of the springs will urge the frame downwardly to a lower position. Downward movement of the frame is limited by engagement of the side members 27 with bolts or stops 35 mounted on the cross member 34.

A coin-operated mechanism is utilized to release the locking mechanism for the cover 11 and enable the cover and frame 26 to move to a lower position. The coin operated mechanism includes a conventional coin receiving unit 36 which is mounted on one of the side walls 3. The unit 36 is provided with a plunger 37 which can be moved inwardly after a coin is inserted in the slot.

As shown by the phantom lines in FIG. 3, inward movement of plunger 37 will cause the plunger to engage the forward end of the pawl bar 18 and pivot the pawl bar counterclockwise about the pivot 19. Pivotal movement of the pawl bar 18 will move the end of the pawl bar out of engagement with the teeth of the ratchet 17, thereby enabling the cover 11 to move by gravity to its closed position. As the cover moves downwardly, the frame 26, which carries pegs 23, will be urged downwardly by springs 32 to move the pegs 23 to a non-obstructing position.

The pawl bar 18 is biased to its original position by a spring 38 which connects the end of the pawl bar to the supporting structure 1 as shown in FIG. 3.

To aid in the raising and lowering of frame 26, a chain 39 is attached to the lower end of the ratchet bar 17 and passes through an eye-bolt 40 and over a series of pulleys 41, 42, 43 and 44, mounted on the frame 1. In passing between the pulleys 43 and 44 the chain travels through a hole 45 in cross member 34. The forward end of the chain 39 is attached to eye-bolt 46 mounted on the side member 27 of frame 26.

Figure 4:
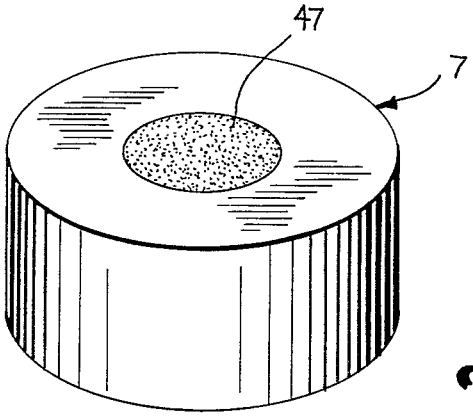
FIG. 4 is a perspective view of a puck.

The puck 7 is shown in FIG. 4 and in one form of the invention, one or more of the pucks can be provided with a central portion 47 having a distinctive color, such as red. In one form of play, the colored-center puck will count a double score if it is shot through one of the gates 6.

To start play of the game, the cover is elevated to remove the pucks from the compartments 9 and upward movement of the cover will act to pivot the frame 26 upwardly and move the pegs 23 into an obstructing position with respect to the gates 6. The cover will be locked in the upper position by the ratchet and pawl mechanism 17 and 18. After the pucks have been removed from the compartments 9, a coin is inserted in the mechanism 36 and the plunger 37 is moved inwardly, thereby releasing the locking mechanism and enabling the cover 11 and frame 26 to move downwardly. Downward movement of the frame 26 will cause the pegs 26 to move to a non-obstructing position.

The game can then be played and when play has proceeded to a point where at least all of the pucks of one player are in the compartments 9, the game is completed. Any attempt to remove the pucks from the compartments by lifting the cover 11 will automatically elevate pegs 23 into an obstructing position and lock the cover in the open position so that the game is not operable.

The invention provides an inexpensive, coin operated game which can be used in commercial establishments and eliminates the high cost and maintenance problems associated with electronically controlled, coin-operated games.

Various modes of carrying out the invention are contemplated as being within the scope of the following claims particularly pointing out and distinctly claiming the subject matter which is regarded as the invention.

I claim:

1. A game apparatus, comprising a supporting structure, a substantially horizontal playing surface mounted on the supporting structure and having a first end and a second end, a transverse and substantially vertically extending wall disposed adjacent the second end and having a series of transversely disposed openings extending from the playing surface, each of said openings being labeled to represent a predetermined score upon entry of a puck playing piece propelled from said first end, a compartment between said wall and said second end communicating with each opening to receive a puck propelled from said first end and passing through the openings, a cover mounted on the supporting structure above said compartment for movement between compartment open and closed positions, movable means mounted in each of said openings for movement with respect to the supporting structure and movable between an obstructing position and an unobstructed position, first connecting means operably connecting the cover and the movable means, whereby movement of the cover to an open position will move said obstructing means to the obstructing position, and second means connected to said movable means for movement thereof to said unobstructed position.

2. The apparatus of claim 1, including locking means for locking the cover in said compartment open position, and a coin operated mechanism operably connected to the locking means whereby insertion of a coin in said mechanism acts to release the locking means and enables the cover to move to the closed position and said movable means to move to said unobstructing position.

3. The aparatus of claim 2, wherein said locking means comprises a ratchet and pawl mechanism interconnecting the cover and the supporting structure.

4. The apparatus of claim 3, wherein said ratchet and pawl mechanism includes a ratchet mounted on the cover and having a series of teeth and a pawl mounted on the supporting structure and disposed to engage said teeth.

5. The apparatus of claim 4, wherein said pawl is mounted for movement with respect to said supporting structure between a locking position and a released position, movement of said pawl to the released position will release said pawl from engagement with the ratchet teeth.

6. The apparatus of claim 1, wherein said playing surface includes a series of holes aligned with said openings, said movable means comprising stops mounted for movement within said holes between said obstructing and said non-obstructing position.

7. The apparatus of claim 6, and including a frame located beneath the playing surface and connected to said stops, said connecting means interconnecting the frame and said cover.

8. The aparatus of claim 1, wherein said openings have different widths and the vertical edge bordering each opening is beveled.

9. A game apparatus, comprising a supporting structure, a substantially horizontal playing surface mounted on the supporting structure and having a first end and a second end, a transverse substantially vertical wall disposed adjacent said second end and having at least one opening, each of said openings being labeled to represent a predetermined score upon entry of a puck playing piece propelled from said first end, a compartment disposed between said wall and said second end on said playing surface, said compartment having an open top and said compartment communicating with said opening in said wall, said compartment being adapted to receive a puck passing through said opening in said wall, a compartment cover hinged to the supporting structure and mounted for movement between compartment open and closed positions, an obstructing member associated with said opening and mounted for movement with respect to said playing surface between an obstructing position, where the obstructing member will prevent a puck from passing through said opening, to a non-obstructing position to allow a puck to pass into said compartment, connecting means operably connecting the cover and the obstructing member, whereby movement of the cover to the open position will move the obstructing member to the obstructing position, locking means to lock the cover in an open position, release means to release the locking means and enable the cover to move to the closed position, and means responsive to operation of said release means for effecting movement of said obstructing member to the non-obstructing position.

10. The apparatus of claim 9, wherein said cover includes viewing means whereby the pucks in the compartment can be viewed through the cover when the cover is in the closed position.

11. The apparatus of claim 9, wherein the release means comprises a coin-operated mechanism operably connected to said locking means, insertion of a coin in said mechanism acting to release said locking means.

12. The apparatus of claim 9, wherein said means responsive to operation of said release means comprises a frame carrying said obstructing member and operably connected to said cover, and means for pivotally connecting said frame to the supporting structure, whereby said frame will pivot downwardly by gravity on release of said locking means to move the obstructing member to a non-obstructing position.

* * * * *